US012611746B1

(12) United States Patent
Lin et al.

(10) Patent No.: US 12,611,746 B1
(45) Date of Patent: Apr. 28, 2026

(54) OVER-POSITIONING GRINDING METHOD OF HARD AND BRITTLE PIPE FITTING WITH LARGE LENGTH-TO-DIAMETER RATIO

(71) Applicant: TIANJIN UNIVERSITY, Tianjin (CN)

(72) Inventors: Bin Lin, Tianjin (CN); Jingguo Zhou, Tianjin (CN); Tianyi Sui, Tianjin (CN); Pengcheng Zhao, Tianjin (CN)

(73) Assignee: TIANJIN UNIVERSITY, Tianjin (CN)

( * ) Notice: Subject to any disclaimer, the term of this patent is extended or adjusted under 35 U.S.C. 154(b) by 0 days.

(21) Appl. No.: 19/209,009

(22) Filed: May 15, 2025

Related U.S. Application Data

(63) Continuation of application No. PCT/CN2024/144247, filed on Dec. 31, 2024.

(30) Foreign Application Priority Data

Dec. 27, 2024 (CN) ..... 202411952903.X

(51) Int. Cl.
*B24B 47/20* (2006.01)
*B24B 1/00* (2006.01)
(Continued)

(52) U.S. Cl.
CPC ..... *B24B 47/206* (2013.01); *B24B 1/00* (2013.01); *B24B 5/04* (2013.01); *B24B 5/22* (2013.01);
(Continued)

(58) Field of Classification Search
CPC .... B24B 5/22; B24B 5/18; B24B 5/30; B24B 5/307; B24B 5/24; B24B 49/00; B24B 41/06; B24B 41/067
(Continued)

(56) References Cited

U.S. PATENT DOCUMENTS 4,083,151 A * 4/1978 Jessup ..... B24B 5/22 451/242
4,570,387 A * 2/1986 Unno ..... B24B 5/22 451/21
(Continued)

FOREIGN PATENT DOCUMENTS

CN 86209906 A 8/1987
CN 1525899 A 9/2004
(Continued)

*Primary Examiner* — Makena S Markman

(57) ABSTRACT

Provided is an over-positioning grinding method of a hard and brittle pipe fitting with large length-to-diameter ratio, which belongs to the field of grinding technologies. The existing machining method cannot increase the grinding accuracy of the external circles of the hard and brittle pipe fittings nor ensure the coaxiality of the external circles and internal circles of the ground hard and brittle pipe fittings, which leads to inconsistent wall thickness of the ground hard and brittle pipe fittings. In the present disclosure, by using the over-positioning supporting of the rigid mandrel, the support plate and the guide wheel for the hard and brittle pipe fitting in a machining process, the guide wheel is driven to rotate forward to push the hard and brittle pipe fitting with large length-to-diameter ratio into the grinding area, and the guide wheel contacts and drives the hard and brittle pipe fitting while rotating reversely.

9 Claims, 4 Drawing Sheets

(51) Int. Cl.

| | |
|---|---|
| ***B24B 5/04*** | (2006.01) |
| ***B24B 5/22*** | (2006.01) |
| ***B24B 5/30*** | (2006.01) |
| ***B24B 5/307*** | (2006.01) |
| ***B24B 41/06*** | (2012.01) |

(52) U.S. Cl.
CPC ..... *B24B 5/30* (2013.01); *B24B 5/307* (2013.01); *B24B 41/067* (2013.01)

(58) Field of Classification Search
USPC ..... 451/49, 407
See application file for complete search history.

(56) References Cited

U.S. PATENT DOCUMENTS 4,712,332 A * 12/1987 Smith ..... B24B 5/22 451/244
4,926,603 A * 5/1990 Frost ..... B24B 5/18 451/5
5,643,051 A * 7/1997 Zhou ..... B24B 5/22 451/5
5,928,065 A * 7/1999 Shih ..... B24B 53/07 451/72
7,997,954 B2 * 8/2011 Kobayashi ..... B24B 5/18 451/49
10,232,484 B2 * 3/2019 Sedlacek ..... B24B 5/225
2003/0236058 A1 * 12/2003 Kamamura ..... B24B 7/16 451/49
2011/0306273 A1 * 12/2011 Tschudin ..... B24B 5/30 451/259

FOREIGN PATENT DOCUMENTS

CN 104385083 A * 3/2015 ..... B24B 19/009
CN 107598687 A 1/2018
CN 115570451 A 1/2023
CN 115673889 A 2/2023
EP 3974106 A1 * 3/2022 ..... B24B 5/22
JP 06246608 A 9/1994
WO WO-2012008356 A1 * 1/2012 ..... B24B 5/30

* cited by examiner

OVER-POSITIONING GRINDING METHOD OF HARD AND BRITTLE PIPE FITTING WITH LARGE LENGTH-TO-DIAMETER RATIO

CROSS-REFERENCE TO RELATED APPLICATIONS

This application is a bypass continuation application of PCT application no.: PCT/CN2024/144247. This application claims priorities from PCT Application PCT/CN2024/144247, filed Dec. 31, 2024, and from Chinese patent application 202411952903.X, filed Dec. 27, 2024, the contents of which are incorporated herein in the entirety by reference.

TECHNICAL FIELD

The present disclosure belongs to the field of grinding technologies and relates to the field of external grinding machining of hard and brittle materials and in particular to an over-positioning grinding method of a hard and brittle pipe fitting with large length-to-diameter ratio.

BACKGROUND

At present, the hard and brittle pipe fittings with large length-to-diameter ratio are widely applied in the fields such as semiconductor, nuclear energy and chemicals and so on. Under special working conditions, the applied hard and brittle pipe fittings with large length-to-diameter ratio are required to have high dimensional and shape accuracy. Due to preparation processes, the rough pipes of the hard and brittle pipe fittings with large length-to-diameter ratio have large dimensional and shape accuracy error and thus cannot directly meet the use requirements, which means it is necessary to machine the hard and brittle pipe fittings to ensure its accuracy. However, because the hard and brittle pipe fittings with large length-to-diameter ratio have structural characteristics of large length-to-diameter ratio and the characteristics of the materials of high hardness and high brittleness, it is difficult to carry out high-precision and high-efficiency precision forming on such parts, which significantly limits the application of these parts such as the hard and brittle pipe fittings with large length-to-diameter ratio in various fields.

The external machining of the existing hard and brittle pipe fittings is usually carried out by external grinding. But the existing machining method cannot increase the grinding accuracy of the external circles of the hard and brittle pipe fittings nor ensure the coaxiality of the external circles and internal circles of the ground hard and brittle pipe fittings, which leads to inconsistent wall thickness of the ground hard and brittle pipe fittings.

SUMMARY

In view of the above, the present disclosure provides an over-positioning grinding method of a hard and brittle pipe fitting with large length-to-diameter ratio, which can realize over-positioning supporting for the hard and brittle pipe fitting in a machining process, so as to increase the grinding accuracy of the external circle of the hard and brittle pipe fitting while ensuring the external circle and internal circle of the ground hard and brittle pipe fitting are coaxial, thereby realizing high-accuracy machining for the hard and brittle pipe fitting with large length-to-diameter ratio.

In order to address the above technical problems, the present disclosure provides the following technical solution.

There is provided an over-positioning grinding method of a hard and brittle pipe fitting with large length-to-diameter ratio, which specifically includes the following grinding process:

at step S1, assembling and positioning of the hard and brittle pipe fitting: a rigid mandrel penetrates through an internal hole of the hard and brittle pipe fitting with large length-to-diameter ratio and is in clearance fit with the hard and brittle pipe fitting; the rigid mandrel is tensioned and the hard and brittle pipe fitting is maintained as horizontal; a position at each end of the rigid mandrel and close to the hard and brittle pipe fitting is supported by one vibration-damping device to lower vibration amplitude and frequency of the rigid mandrel in the machining process of the hard and brittle pipe fitting; a support plate is in contact with an external pipe surface of the hard and brittle pipe fitting and supports the hard and brittle pipe fitting;

at step S2, determining a grinding area: a grinding wheel and a guide wheel are respectively located at both sides of the hard and brittle pipe fitting and axes of the grinding wheel and the guide wheel are maintained at a same height; heights of the grinding wheel and the guide wheel are adjusted to ensure there is a height difference between the axes of the guide wheel and the grinding wheel and an axis of the hard and brittle pipe fitting; a grinding surface of the grinding wheel is opposite to a guide supporting surface of the guide wheel in a forward direction; the grinding wheel, the guide wheel and the support plate enclose the grinding area of the hard and brittle pipe fitting, and carry out over-positioning supporting for the hard and brittle pipe fitting in cooperation with the rigid mandrel;

at step S3, guide wheel positioning: the hard and brittle pipe fitting is moved to the grinding area and the guide wheel moves toward the hard and brittle pipe fitting until the guide supporting surface of the guide wheel contacts and squeezes the external pipe surface of the hard and brittle pipe fitting so that a pre-pressure is present between the guide wheel and the hard and brittle pipe fitting; the hard and brittle pipe fitting moves out of the grinding area and the guide wheel remains in original position;

at step S4, cutter alignment: the guide wheel is driven to rotate forward to push the hard and brittle pipe fitting with large length-to-diameter ratio into the grinding area; the guide wheel contacts and drives the hard and brittle pipe fitting to advance while rotating reversely; the grinding wheel reversely rotates and performs micro feed toward the hard and brittle pipe fitting to realize cutter alignment operation;

at step S5, grinding the hard and brittle pipe fitting: a rotation speed and a feed speed of the guide wheel and a rotation speed and a feed speed of the grinding wheel are set, and a grinding amount of the hard and brittle pipe fitting is set; the guide wheel is driven to rotate forward to push the hard and brittle pipe fitting with large length-to-diameter ratio into the grinding area, and the guide wheel contacts and drives the hard and brittle pipe fitting while rotating reversely, and the grinding wheel reversely rotates and performs feed toward the hard and brittle pipe fitting; along with grinding and feeding of the grinding wheel, the guide wheel and the support plate perform feed toward the hard and brittle pipe fitting so as to always maintain the over-positioning supporting of the guide wheel, the support plate and the rigid mandrel for the hard and brittle pipe fitting; along with the movement of the hard and brittle pipe fitting, the grinding machining of the hard and brittle pipe fitting with large length-to-diameter ratio is realized.

Furthermore, in the step S5, a linear speed of the grinding wheel is 30 m/s.

Furthermore, in the step S5, when an outer diameter of the grinding wheel is 400 mm, the rotation speed of the grinding wheel is 1400 rpm/min to 1500 rpm/min.

Furthermore, in the step S5, the working rotation speed of the guide wheel is 15 rpm/min to 20 rpm/min.

Furthermore, a fit clearance of the rigid mandrel and the hard and brittle pipe fitting is 0.2 to 0.5 mm.

Furthermore, the support plate is disposed close to the grinding wheel and obliquely supports the hard and brittle pipe fitting; a supporting surface of the support plate is an inclined surface, and an inclination angle of the supporting surface is 30°.

Furthermore, the grinding wheel is a parallel grinding wheel.

Furthermore, the grinding wheel is a cup-shaped grinding wheel, and there is an offset angle θ between an axis of the cup-shaped grinding wheel and the axis of the hard and brittle pipe fitting, where θ>0.

Furthermore, in the step S2, the height difference between the axes of the guide wheel and the grinding wheel and the axis of the hard and brittle pipe fitting can be obtained as below.

A radius of the external circle of the hard and brittle pipe fitting with large length-to-diameter ratio is $R_w$, a radius of the guide wheel is $R_c$, a radius of the grinding wheel is $R_g$, and the height difference between the axis of the hard and brittle pipe fitting and the axis of the grinding wheel is h; when the grinding wheel comes in contact with the hard and brittle pipe fitting, an initial contact point of the grinding wheel and the hard and brittle pipe fitting is A, and a tangent line of the point A is l; when the guide wheel comes in contact with the hard and brittle pipe fitting, an initial contact point of the guide wheel and the hard and brittle pipe fitting is B; when the support plate comes in contact with the hard and brittle pipe fitting, an initial contact point of the support plate and the hard and brittle pipe fitting is C;

the axis of the hard and brittle pipe fitting is O, the center of the guide wheel is $O_c$, the center of the grinding wheel is $O_g$, $\angle AOC=\alpha$, $\angle BOC=\beta$, $\angle AO_gO_c=\beta_g$, $\angle O_gO_cB=\beta_c$, β is a grinding angle of the grinding wheel, δ is an included angle between OA and a horizontal line, and an inclination angle of the supporting surface of the support plate γ; a right angle coordinate system is established with $O_g$ as center of circle, and the coordinate of the tangent point A in the coordinate system $xO_gy$ is (x,y); when there is an offset angle θ between the axis of the grinding wheel and the axis of the hard and brittle pipe fitting, the grinding wheel grinds at the offset angle θ, and the profile of the grinding wheel is projected perpendicular to the feed speed direction, and then an elliptic curve equation in the $xO_gy$ can be expressed as:

$$\frac{x^2}{(R_g\sin\theta)^2}+\frac{y^2}{R_g^2}=1 \tag{1}$$

where y is a height difference from the tangent point A to the axis of the grinding wheel, and x is a horizontal distance from the tangent point A to the vertical axis y; the following expression can be obtained from the formula (1):

$$x=R_g\sin\theta\cos\beta_g \tag{2}$$

$$y=R_g\sin\beta_g \tag{3}$$

a slope of the tangent line l through the tangent point A on the elliptic curve can be expressed as:

$$k=-\frac{\cot\beta_g}{\sin\theta} \tag{4}$$

because the tangent value of the slope of the tangent line l is the included angle of the tangent line l and the X axis, the angle δ of the tangent line l and the x axis can be obtained from the formula (4):

$$\frac{\pi}{2}-\delta=|\arctan(k)| \tag{5}$$

based on geometrical relationship, the following formula can be obtained:

$$\beta_c\approx h/(R_w+R_c) \tag{6}$$

$$h=y+R_w\sin\delta \tag{7}$$

$$\beta=\beta_c+\delta=\pi-\phi-\alpha \tag{8}$$

the following can be obtained by substituting δ, y, $\beta_c$ into the formulas (7) and (8):

$$\beta=\frac{h}{R_w+R_c}+\frac{\pi}{2}-\left|\arctan\left(-\frac{\cot\beta_g}{\sin\theta}\right)\right| \tag{9}$$

$$h=R_g\sin\beta_g+R_w\cos\left(\left|\arctan\left(-\frac{\cot\beta_g}{\sin\theta}\right)\right|\right) \tag{10}$$

in trigonometric function, when the angle is small, the following reduction can appear:

$$\arctan\left(-\frac{\cot\beta_g}{\sin\theta}\right)\approx-\frac{\pi}{2}+\frac{\sin\theta}{\cot\beta_g} \tag{11}$$

$$\cot(\beta_g)\approx 1/\beta_g \tag{12}$$

therefore, when the formulas (11) and (12) are substituted into the formulas (9) and (10), the following can be obtained:

$$\beta=\frac{h}{R_w+R_c}+\beta_g\sin\theta \tag{13}$$

$$h=R_g\beta_g+R_w\beta_g\sin\theta \tag{14}$$

by combining the formulas (13) and (14), the following can be obtained:

$$h = \frac{(R_w + R_c)(R_g + R_w \sin\theta)}{R_g + 2R_w \sin\theta + R_c \sin\theta} \frac{\pi}{180}\beta. \tag{15}$$

Furthermore, the grinding angle β can be obtained in the following process:

based on geometrical relationship, the following formula can be obtained:

$$\alpha = \frac{\pi}{2} - \delta - \gamma \tag{16}$$

$$\phi = \frac{\pi}{2} - \beta_c + \gamma \tag{17}$$

a stability increase coefficient $A_i$ can be expressed as:

$$A_i = 1 + \frac{\sin(\alpha)}{\sin(\phi)} \cos i(\alpha + \phi) - \frac{\sin(\alpha + \phi)}{\sin(\phi)} \cos(i\alpha) \tag{18}$$

in combination with the formulas (4) to (17), the formula (18) can be converted into the following formula with only variables angles β and γ:

$$A_i = 1 + \frac{\sin\left(\frac{\pi}{2} + \left(\frac{\beta\pi(R_g + R_c \sin\theta)}{180(R_g + 2R_w \sin\theta + R_c \sin\theta)}\right) - \gamma - \beta\right)}{\cos\left(\left(\frac{\beta\pi(R_g + R_c \sin\theta)}{180(R_g + 2R_w \sin\theta + R_c \sin\theta)}\right) - \gamma\right)} \cos i(\pi - \beta) - \frac{\sin(\beta)}{\cos\left(\left(\frac{\beta\pi(R_g + R_c \sin\theta)}{180(R_g + 2R_w \sin\theta + R_c \sin\theta)}\right) - \gamma\right)} \cos\left(i\left(\frac{\pi}{2} + \left(\frac{\beta\pi(R_g + R_c \sin\theta)}{180(R_g + 2R_w \sin\theta + R_c \sin\theta)}\right) - \gamma - \beta\right)\right)$$

based on the open-source python and the stability increase coefficient $A_i$, a stability diagram is obtained. When $A_i > 0$, it is a stable area. Based on the inclination angle γ of the supporting surface of the support plate, a range value of β is selected in the stable area.

Compared with the prior arts, the present disclosure has the following beneficial effects.

1. The support plate performs oblique supporting for the surface of the hard and brittle pipe fitting, and the guide wheel and the grinding wheel also achieve supporting and positioning effect on the hard and brittle pipe fitting; the support plate, the guide wheel and the grinding wheel all have upward supporting for the hard and brittle pipe fitting and form the grinding area. The rigid mandrel is in clearance fit with the hard and brittle pipe fitting, which ensures the rotation and advance of the hard and brittle pipe fitting. Further, the rigid mandrel can, when in a tensioned state, also always maintain the hard and brittle pipe fitting horizontal, that is, the hard and brittle pipe fitting is tightly pressed in the grinding area and supported and positioned at multiple points during a machining process, which not only realizes over-positioning stable supporting for the hard and brittle pipe fitting but also provides positioning reference for the machining of the external circle of the workpiece. When the hard and brittle pipe fitting is supported in this over-positioning manner, the grinding accuracy of the external circle of the hard and brittle pipe fitting can be increased and the coaxiality of the external circle and the internal circle of the ground hard and brittle pipe fitting can be guaranteed, realizing high accuracy machining of the hard and brittle pipe fitting with large length-to-diameter ratio.
2. The guide wheel is of hyperboloid-of-one-sheet structure, which can not only bring the workpiece to rotate stably to realize uniform machining of the external circular surface of the workpiece, but also drive the workpiece to advance with constant speed, thereby realizing uniform machining of the workpiece in a length direction.
3. The grinding wheel can be a parallel grinding wheel or a cup-shaped grinding wheel; when the grinding wheel is a cup-shaped grinding wheel, the rotational axis of the cup-shaped grinding wheel is perpendicular to its advance speed direction so that the grinding of the feed direction is changed into external circular surface grinding rather than plane grinding, reducing smaller grinding force. The removing material of the external circular surface of the grinding wheel can have smaller contact area and therefore, finer cutting control can be carried out for the workpiece. Particularly, this cutting control can be applied to high-accuracy external circle grinding, reaching higher surface quality and dimensional accuracy. Furthermore, since the cutting area of the cup-shaped grinding wheel is centralized, smaller force is applied for the grinding, reducing the influence of the cutting force. The motion trajectory of the abrasive particles of the end face of the grinding wheel is parallel to a material forming surface, which can not only realize large-cutting-depth grinding but also lower the grinding force of the grinding wheel for the workpiece, avoiding damage to the workpiece with hard and brittle characteristics. Therefore, the workpiece surface with less sub-surface damage can be produced. The cup-shaped grinding wheel can be properly adjusted in angle or dressed to extend its service life and lower the change frequency of the grinding tool.

BRIEF DESCRIPTIONS OF THE DRAWINGS

The drawings as a part of the present disclosure, are provided for further understanding of the present disclosure.

The numerals of the drawings are described below: 1. rigid mandrel, 2. hard and brittle pipe fitting, 3. support plate, 4. guide wheel, 5. grinding wheel, 6. vibration-damping device.

DETAILED DESCRIPTIONS OF EMBODIMENTS

The present disclosure will be detailed below in combination with specific embodiments.

Figure 1:
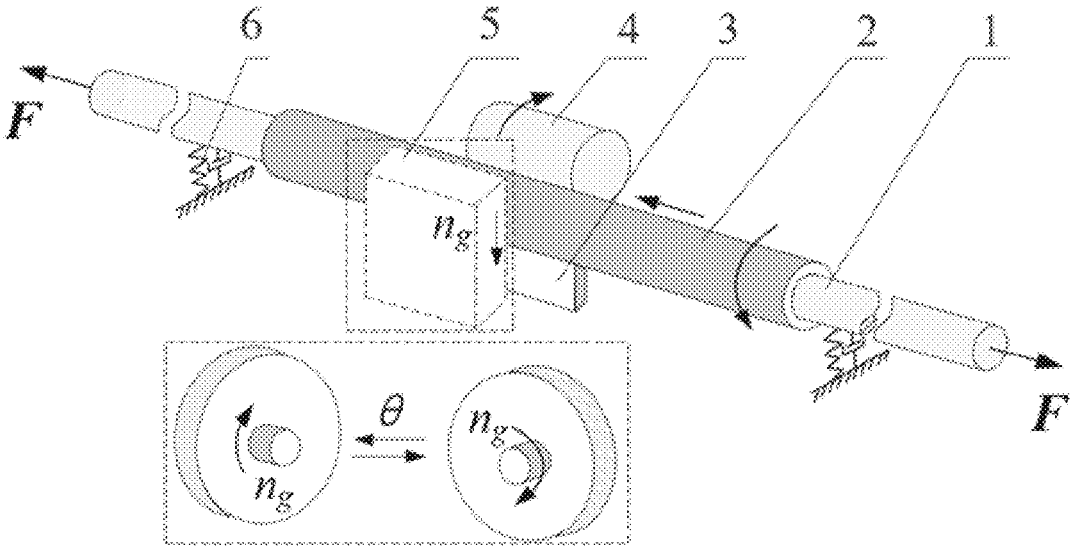
FIG. 1 is a schematic diagram illustrating an entire structure of assembling a hard and brittle pipe fitting and an over-positioning grinding device.
Figure 2:
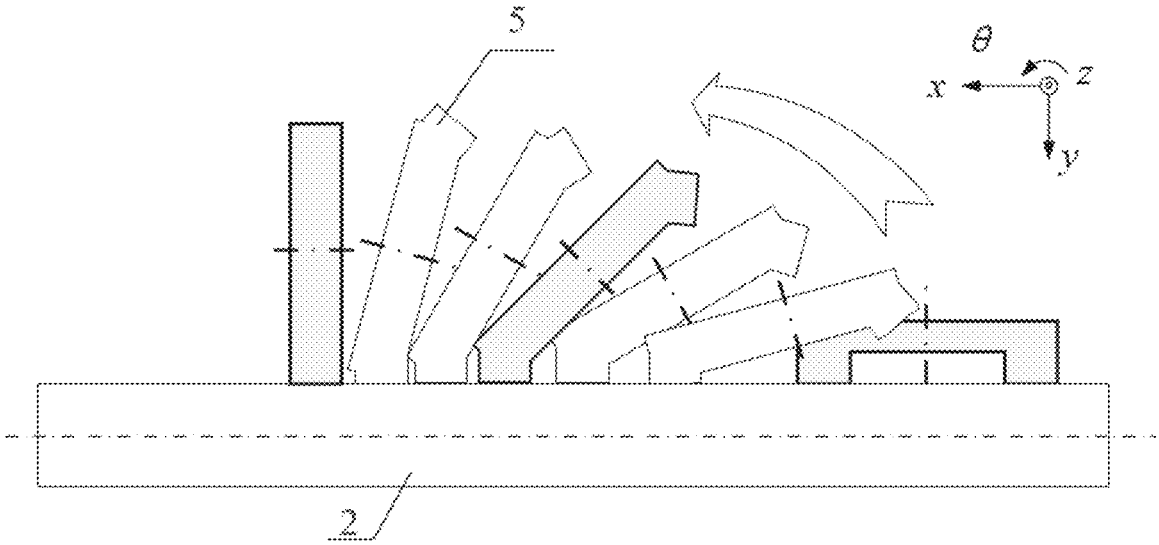
FIG. 2 is a schematic diagram illustrating grinding wheel morphologies and contact with a hard and brittle pipe fitting in a machining process of the hard and brittle pipe fitting.

With reference to FIGS. 1 and 2, an embodiment provides an over-positioning grinding method of a hard and brittle pipe fitting with large length-to-diameter ratio, which is carried out by an over-positioning grinding device. As shown in FIG. 1, it is a schematic diagram illustrating an entire structure of assembling the hard and brittle pipe fitting and the over-positioning grinding device. The over-positioning grinding device includes a rigid mandrel 1, a vibration-damping device 6, a support plate 3, a grinding wheel 5 and a guide wheel 4. The rigid mandrel 1 is horizontally disposed to support the hard and brittle pipe fitting 2 with large length-to-diameter ratio. Since the hard and brittle pipe fitting 2 is a pipe fitting with large length-to-diameter ratio and the rigid mandrel 1 penetrates through an internal hole of the hard and brittle pipe fitting 2 to support the hard and brittle pipe fitting 2, the rigid mandrel 1 also serves as a support member with large length-to-diameter ratio. The rigid mandrel 1 tends to bend down and therefore both ends of the rigid mandrel 1 are tensioned with a tensioning device when the rigid mandrel 1 supports the hard and brittle pipe fitting 2, so as to always maintain the rigid mandrel 1 and the hard and brittle pipe fitting 2 horizontal. The support plate 3 is disposed below the rigid mandrel 1 to support the hard and brittle pipe fitting 2 with large length-to-diameter ratio. With the support of the rigid mandrel 1 and the support plate 1 for the hard and brittle pipe fitting 2, the hard and brittle pipe fitting 2 is always in a horizontal state during a machining process. There are two vibration-damping devices 6, which are disposed at both ends of the rigid mandrel 1 respectively to support the rigid mandrel 1. Since the hard and brittle pipe fitting 2 can generate vibration during a machining process, the rigid mandrel 2 can also generate vibration under inertial effect. The vibration-damping devices 6 can reduce a vibration amplitude and frequency of the rigid mandrel 1 and further reduce a vibration amplitude and frequency of the hard and brittle pipe fitting 2, increasing the machining accuracy of the hard and brittle pipe fitting 2. The guide wheel 4 is mounted at a side of the rigid mandrel 1 to rotate and advance the workpiece and ensure smooth machining of the workpiece. The grinding wheel 5 is mounted at other side of the rigid mandrel 1 to grind an external circle of the hard and brittle pipe fitting 2.

The over-positioning grinding process of the hard and brittle pipe fitting 2 is carried out in the following steps.

At step S1, assembling and positioning the hard and brittle pipe fitting: as shown in FIG. 1, the rigid mandrel 1 penetrates through the internal hole of the hard and brittle pipe fitting 2 with large length-to-diameter ratio and is in clearance fit with the hard and brittle pipe fitting 2; the fit clearance of the rigid mandrel 1 and the hard and brittle pipe fitting 2 is 0.2 to 0.5 mm, which not only ensures the hard and brittle pipe fitting 2 can move along the length direction of the rigid mandrel 1 but also realizes positioning supporting for the hard and brittle pipe fitting 2. The rigid mandrel 1 is tensioned and the hard and brittle pipe fitting 2 is maintained horizontal; a position at each end of the rigid mandrel 1 and close to the hard and brittle pipe fitting 2 is supported by one vibration-damping device 6, so as to reduce the vibration amplitude and frequency of the rigid mandrel 1 in the machining process of the hard and brittle pipe fitting and further reduce the vibration amplitude and frequency of the hard and brittle pipe fitting 2, increasing the machining accuracy of the workpiece; the support plate 3 is in slight contact with an external pipe surface of the hard and brittle pipe fitting 2 and obliquely supports the hard and brittle pipe fitting 2. The support plate 3 is disposed close to the grinding wheel 5 and a supporting surface of the support plate 3 is an inclined surface of 30°.

At step S2, determining a grinding area: the grinding wheel 5 and the guide wheel 4 are respectively located at both sides of the hard and brittle pipe fitting 2 and axes of the grinding wheel 5 and the guide wheel 4 are maintained at a same height; heights of the grinding wheel 5 and the guide wheel 4 are adjusted to ensure the axes of the guide wheel 4 and the grinding wheel 5 are lower than the axis of the hard and brittle pipe fitting 2; a grinding surface of the grinding wheel 5 is opposite to a guide supporting surface of the guide wheel 4 in a forward direction; the rigid mandrel 1, the grinding wheel 5, the guide wheel 4 and the support plate 3 enclose the grinding area of the hard and brittle pipe fitting 2 for over-positioning supporting.

At step S3, guide wheel positioning: the hard and brittle pipe fitting 2 is moved to the grinding area and the guide wheel 4 moves toward the hard and brittle pipe fitting 2 until the guide supporting surface of the guide wheel 4 contacts and squeezes the external pipe surface of the hard and brittle pipe fitting 2 so that a pre-pressure is present between the guide wheel 4 and the hard and brittle pipe fitting 2; the hard and brittle pipe fitting 2 moves out of the grinding area and the guide wheel 4 remains in original position.

At step S4, cutter alignment: the guide wheel 4 is driven to rotate forward to push the hard and brittle pipe fitting 2 with large length-to-diameter ratio into the grinding area; the guide wheel 4 contacts and drives the hard and brittle pipe fitting 2 to advance while rotating reversely; the grinding wheel 5 reversely rotates and performs micro feed toward the hard and brittle pipe fitting 2 to realize cutter alignment operation.

At step S5, grinding the hard and brittle pipe fitting: a rotation speed and a feed speed of the guide wheel 4 and a rotation speed and a feed speed of the grinding wheel 5 are set, and a grinding amount of the hard and brittle pipe fitting 2 is set; the guide wheel 4 is driven to rotate forward at the speed of 15 rpm/min to 20 rpm/min to push the hard and brittle pipe fitting 2 with large length-to-diameter ratio into the grinding area, and the guide wheel 4 contacts and drives the hard and brittle pipe fitting 2 to advance while rotating reversely, and the grinding wheel 5 reversely rotates and performs feed toward the hard and brittle pipe fitting 2, where a linear speed of the grinding wheel 5 is 30 m/s; when the external diameter of the grinding wheel 5 is 400 mm, and the rotation speed of the grinding wheel 5 is 1400 rpm/min to 1500 rpm/min; along with grinding and feeding of the grinding wheel 5, the surface of the hard and brittle pipe fitting is gradually removed, and a pre-tightening force of the guide wheel 4 and the support plate 3 for the hard and brittle pipe fitting 2 gradually decreases, which affects the machining accuracy of the hard and brittle pipe fitting 2; therefore, along with the machining of the hard and brittle pipe fitting 2, the grinding wheel 5 gradually performs feed while the guide wheel 4 and the support plate 3 also gradually perform feed, which ensures relatively constant pre-tightening force for the hard and brittle pipe fitting 2 and at the same time, always maintains the over-positioning supporting of the guide wheel 4, the support plate 3 and the rigid mandrel 1 for the hard and brittle pipe fitting 2; along with the movement of the hard and brittle pipe fitting 2, the grinding machining of the hard and brittle pipe fitting 2 with large length-to-diameter ratio is realized.

Figure 3:
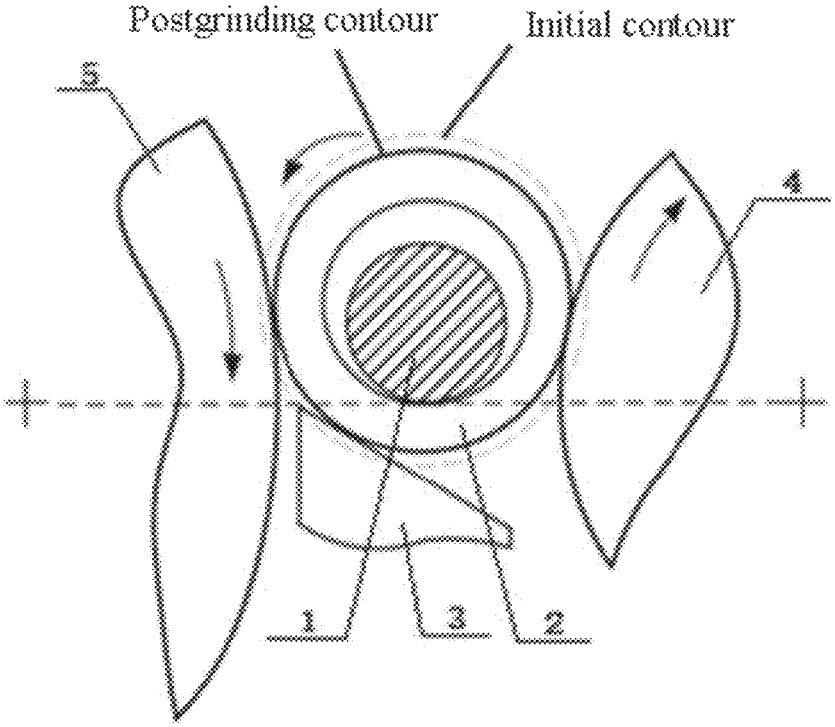
FIG. 3 is a schematic diagram illustrating over-positioning cooperation of a grinding wheel, a rigid mandrel, a support plate and a guide wheel in a machining process of a hard and brittle pipe fitting.
Figure 4:
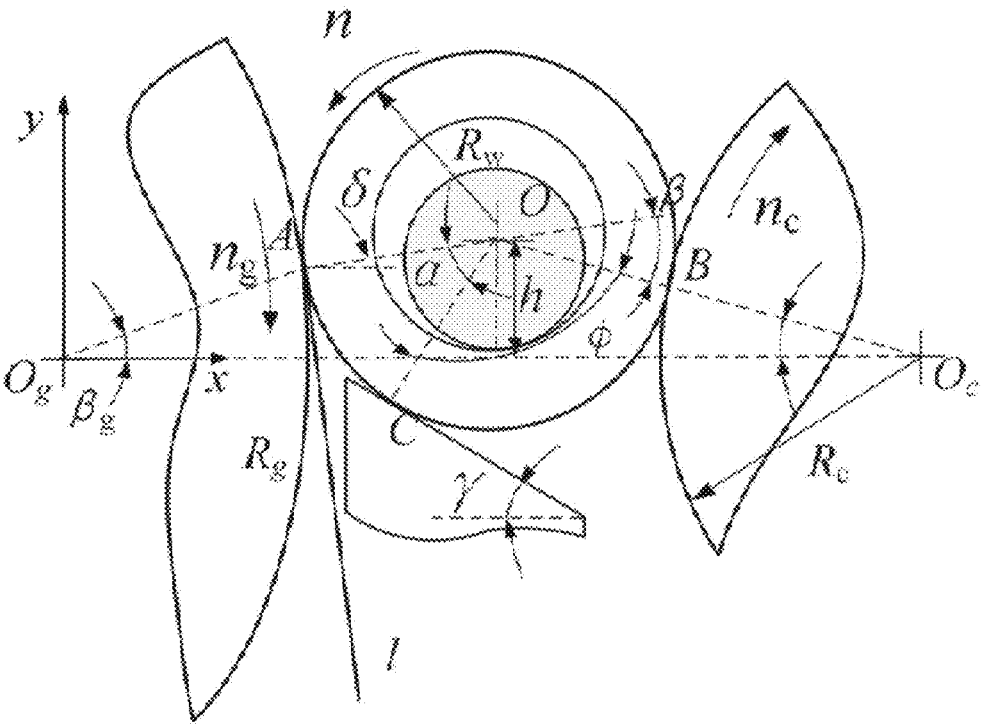
FIG. 4 is a schematic diagram illustrating a working principle of over-positioning geometrical layout in a grinding process of a hard and brittle pipe fitting.

As shown in FIGS. 3 and 4, the support plate 3 is disposed close to the grinding wheel 5, and achieves oblique supporting for the surface of the hard and brittle pipe fitting 2, and the contact points of the guide wheel 4 and the grinding wheel 5 with the hard and brittle pipe fitting 2 are both lower than the axis of the hard and brittle pipe fitting 2. Therefore, when the hard and brittle pipe fitting 2 is ground, the guide wheel 4 and the grinding wheel 5 also achieve supporting and positioning effect on the hard and brittle pipe fitting 2. However, the support plate 3, the guide wheel 4 and the grinding wheel 5 all support the hard and brittle pipe fitting 2 upward and form the grinding area. The rigid mandrel 1 is in clearance fit with the hard and brittle pipe fitting 2, which ensures the rotation and advance of the hard and brittle pipe fitting 2. Further, the rigid mandrel 1 can, when in a tensioned state, also always maintain the hard and brittle pipe fitting 2 horizontal, that is, the hard and brittle pipe fitting 2 is tightly pressed in the grinding area and supported and positioned at multiple points during a machining process, which not only realizes over-positioning stable supporting for the hard and brittle pipe fitting 2 but also provides positioning reference for the machining of the external circle of the workpiece. When the hard and brittle pipe fitting 2 is supported in this over-positioning manner, the grinding accuracy of the external circle of the hard and brittle pipe fitting 2 can be increased and the coaxiality of the external circle and the internal circle of the ground hard and brittle pipe fitting 2 can be guaranteed, realizing high accuracy machining of the hard and brittle pipe fitting 2 with large length-to-diameter ratio. As shown in FIG. 3, the dashed circular contour line is a contour line of the initial position of the hard and brittle pipe fitting 2, and the solid circular contour line is a contour line of the ground hard and brittle pipe fitting 2. It can be seen from FIG. 3 that the two contour lines before and after grinding are coaxial and share the same axis with the internal circle, which ensures the coaxiality of the internal circle and the external circle of the ground workpiece.

In this embodiment, the guide wheel 4 is of hyperboloid-of-one-sheet structure, which can not only bring the workpiece to rotate stably to realize uniform machining of the external circular surface of the workpiece but also drive the workpiece to advance with constant speed, thereby realizing uniform machining of the workpiece in a length direction. The grinding wheel 5 can be a parallel grinding wheel or a cup-shaped grinding wheel; when the grinding wheel 5 is a cup-shaped grinding wheel, the rotational axis of the cup-shaped grinding wheel is perpendicular to its advance speed direction so that the grinding of the feed direction is changed into external circular surface grinding rather than plane grinding, reducing smaller grinding force. The removing material of the external circular surface of the grinding wheel can have smaller contact area and therefore, finer cutting control can be carried out for the workpiece. Particularly, this cutting control can be applied to high-accuracy external circle grinding, reaching higher surface quality and dimensional accuracy. Furthermore, since the cutting area of the cup-shaped grinding wheel is centralized, smaller force is applied for the grinding, reducing the influence of the cutting force. The motion trajectory of the abrasive particles of the end face of the grinding wheel is parallel to a material forming surface, which can not only realize large-cutting-depth grinding but also lower the grinding force of the grinding wheel for the workpiece, avoiding damage to the workpiece with hard and brittle characteristics. Therefore, the workpiece surface with less sub-surface damage can be produced. The cup-shaped grinding wheel can be properly adjusted in angle or dressed to extend its service life and lower the change frequency of the grinding tool. Since the annular grinding surface at the mouth of the cup-shaped grinding wheel is used to remove material, if the axis of the cup-shaped grinding wheel is perpendicular to the axis of the workpiece, there may be two grinding contact surfaces between the cup-shaped grinding wheel and the work piece surface, leading to repeated grinding of the workpiece and affecting the machining quality of the workpiece. Therefore, the included angle $\theta$ between the grinding surface of the cup-shaped grinding wheel and the workpiece surface is set to $\theta>0$ so that a small area of dot contact grinding between the cup-shaped grinding wheel and the workpiece surface is formed, avoiding low damage to the workpiece. Since the parallel grinding wheel has only one grinding end face, when the parallel grinding wheel is used for machining, the parallel grinding wheel is paralleled to the hard and brittle pipe fitting 2.

When the workpiece enters the grinding area for grinding, the supporting surface of the support plate 3 comes in slight contact with the workpiece surface to realize supporting purpose. It should be noted that before the guide wheel 4 comes in contact with the workpiece surface, only a slight contact is present between the support plate 3 and the workpiece surface. When the guide wheel 4 contacts and drives the workpiece to rotate and advance, the slight contact between the workpiece and the supporting surface of the support plate 3 is changed into contact, increasing the contact area therebetween. The guide wheel 4, the rigid mandrel 1 and the support plate 3 produce a proper pre-tightening force for the workpiece to ensure the machining accuracy of the workpiece surface. If, before the guide wheel 4 comes in contact with the workpiece surface, large-area contact supporting is present between the support plate 3 and the workpiece surface, when the guide wheel 4 contacts and drives the workpiece to rotate and advance, a supporting force between the support plate 3 and the workpiece is increased, easily leading to lower machining accuracy of the workpiece. Furthermore, it is best to ensure the inclination angle of the supporting surface of the support plate 3 is about 30°. The stability interval is maximum within the angle range of the support plate, and the rounding effect is maximized.

In a practical machining process, it is required to first determine the grinding angle of the grinding wheel for grinding. But, when the guide wheel, the grinding wheel and the hard and brittle pipe fitting are adjusted in position, the grinding angle is difficult to measure, which increases the difficulty in adjustment to the positions of the guide wheel, the grinding wheel and the hard and brittle pipe fitting. Therefore, in this embodiment, the height difference h between the axis of the hard and brittle pipe fitting and the axis of the grinding wheel is determined based on the grinding angle $\beta$, making it easier to adjust the positions of the grinding wheel and the guide wheel.

FIG. 4 is a schematic diagram illustrating a working principle of the over-positioning geometrical layout in a grinding process of the hard and brittle pipe fitting. The height difference h between the axes of the guide wheel and the grinding wheel and the axis of the hard and brittle pipe fitting is obtained in the following manner.

A radius of the external circle of the hard and brittle pipe fitting with large length-to-diameter ratio is $R_w$, a radius of the guide wheel is $R_c$, a radius of the grinding wheel is $R_g$, and the height difference between the axis of the hard and brittle pipe fitting and the axis of the grinding wheel is h; when the grinding wheel comes in contact with the hard and brittle pipe fitting, an initial contact point of the grinding wheel and the hard and brittle pipe fitting is A, and a tangent line of the point A is l; when the guide wheel comes in contact with the hard and brittle pipe fitting, an initial contact point of the guide wheel and the hard and brittle pipe fitting is B; when the support plate comes in contact with the hard and brittle pipe fitting, an initial contact point of the support plate and the hard and brittle pipe fitting is C;

assume the axis of the hard and brittle pipe fitting is O, the center of the guide wheel is $O_c$, the center of the grinding wheel is $O_g$, $\angle AOC=\alpha$, $\angle BOC=\phi$, $\angle AO_gO_c=\beta_g$, $\angle LO_gO_cB=\beta_c$, β is a grinding angle of the grinding wheel, δ is an included angle between O and a horizontal line, and an inclination angle of the supporting surface of the support plate γ; a right angle coordinate system is established with $O_g$ as center of circle, and the coordinate of the tangent point A in the coordinate system $xO_gy$ is (x,y); when there is an offset angle between the axis of the grinding wheel and the axis of the hard and brittle pipe fitting, the offset angle is θ. The grinding wheel grinds at the offset angle θ. On the section perpendicular to the feed speed direction, the grinding wheel profile is projected as an elliptical curve, and its elliptical curve equation in the $xO_gy$ can be expressed as:

$$\frac{x^2}{(R_g\sin\theta)^2}+\frac{y^2}{R_g^2}=1 \tag{1}$$

when Δy is utilized to represent a height difference from the tangent point A to the axis of the grinding wheel, and Δx is utilized to represent a horizontal distance from the tangent point A to the vertical axis y;

the following expression can be obtained from the formula (1):

$$\Delta x = R_g\sin\theta\cos\beta_g \tag{2}$$

$$\Delta y = R_g\sin\beta_g \tag{3}$$

a slope of the tangent line l through the tangent point A on the elliptic curve can be expressed as:

$$k=-\frac{\cot\beta_g}{\sin\theta} \tag{4}$$

because the tangent value of the slope of the tangent line l is the included angle of the tangent line l and the X axis, the angle δ of the tangent line l and the x axis can be obtained from the formula (4):

$$\frac{\pi}{2}-\delta=|\arctan(k)| \tag{5}$$

based on geometrical relationship, the following formula can be obtained:

$$\beta_c \approx h/(R_w+R_c) \tag{6}$$

$$h = y + R_w\sin\delta \tag{7}$$

$$\beta=\beta_c+\delta=\pi-\phi-\alpha \tag{8}$$

the following can be obtained by substituting δ, y, $\beta_c$ into the formulas (7) and (8):

$$\beta=\frac{h}{R_w+R_c}+\frac{\pi}{2}-\left|\arctan\left(-\frac{\cot\beta_g}{\sin\theta}\right)\right| \tag{9}$$

$$h=R_g\sin\beta_g+R_w\cos\left(\left|\arctan\left(-\frac{\cot\beta_g}{\sin\theta}\right)\right|\right) \tag{10}$$

in trigonometric function, when the angle is small, the following reduction can appear:

$$\arctan\left(-\frac{\cot\beta_g}{\sin\theta}\right)\approx-\frac{\pi}{2}+\frac{\sin\theta}{\cot\beta_g} \tag{11}$$

$$\cot(\beta_g)\approx 1/\beta_g \tag{12}$$

therefore, when the formulas (11) and (12) are substituted into the formulas (9) and (10), the following can be obtained:

$$\beta=\frac{h}{R_w+R_c}+\beta_g\sin\theta \tag{13}$$

$$h=R_g\beta_g+R_w\beta_g\sin\theta \tag{14}$$

by combining the formulas (13) and (14), the following can be obtained:

$$h=\frac{(R_w+R_c)(R_g+R_w\sin\theta)}{R_g+2R_w\sin\theta+R_c\sin\theta}\frac{\pi}{180}\beta. \tag{15}$$

Figure 5:
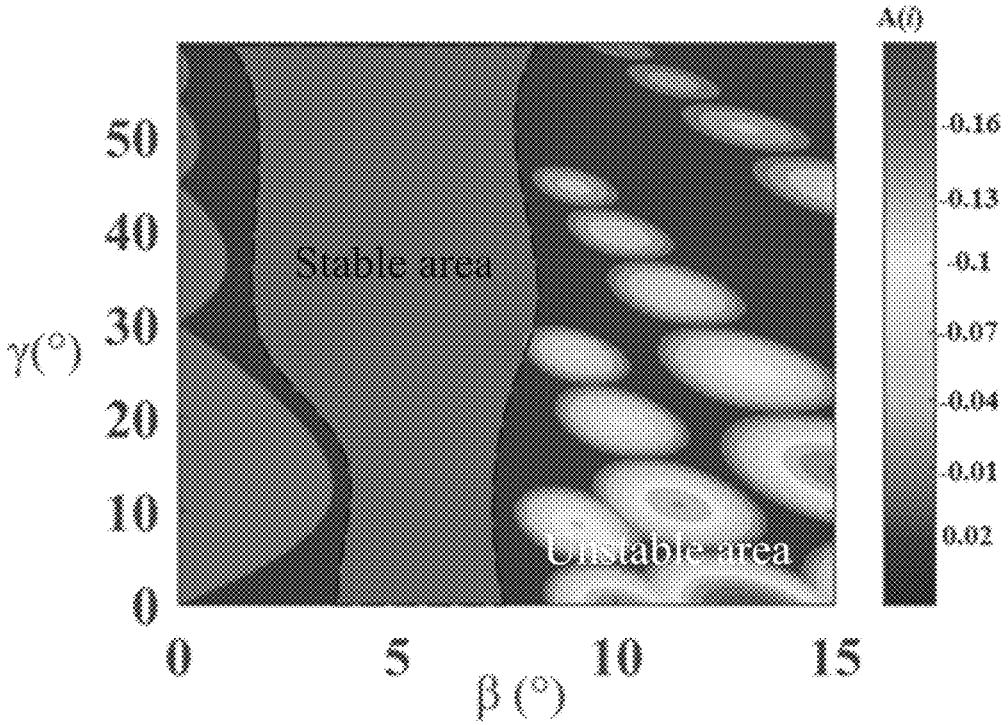
FIG. 5 is a diagram of determining a grinding angle based on a stability diagram.
Figure 6:
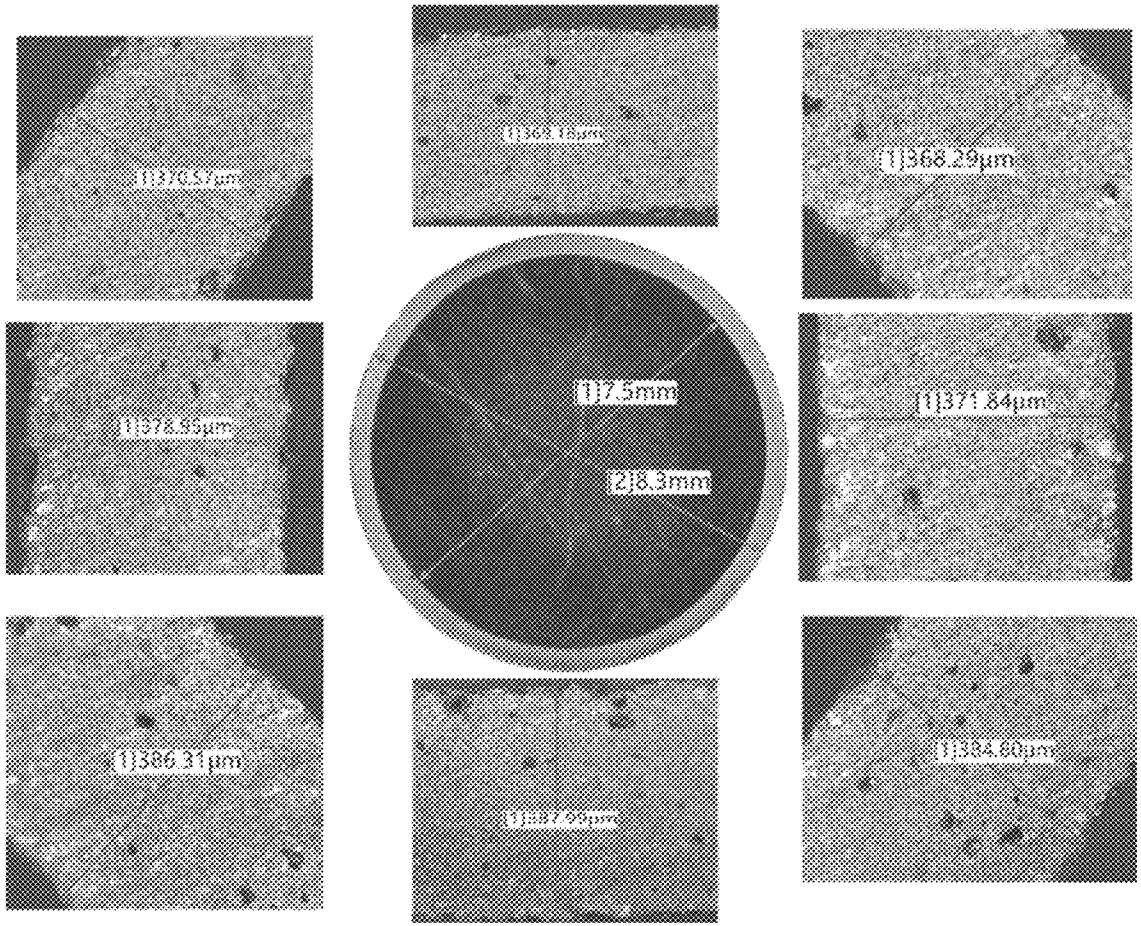
FIG. 6 is a real object diagram of a hard and brittle pipe fitting subjected to over-positioning grinding machining, where one meter of silicon carbide pipe is ground and sampled to observe the measurement of its thickness.

Furthermore, the grinding angle β can be obtained in the following process:

based on geometrical relationship, the following formula can be obtained:

$$\alpha=\frac{\pi}{2}-\delta-\gamma \tag{16}$$

$$\phi=\frac{\pi}{2}-\beta_c+\gamma \tag{17}$$

a stability increase coefficient $A_i$ can be expressed as:

$$A_i=1+\frac{\sin(\alpha)}{\sin(\phi)}\cos i(\alpha+\phi)-\frac{\sin(\alpha+\phi)}{\sin(\phi)}\cos(i\alpha) \tag{18}$$

in combination with the formulas (4) to (17), the formula (18) can be converted into the following formula with only variables angles β and γ:

$$A_i = 1 + \frac{\sin\left(\frac{\pi}{2} + \left(\frac{\beta\pi(R_g + R_c\sin\theta)}{180(R_g + 2R_w\sin\theta + R_c\sin\theta}\right) - \gamma - \beta\right.}{\cos\left(\left(\frac{\beta\pi(R_g + R_c\sin\theta)}{180(R_g + 2R_w\sin\theta + R_c\sin\theta}\right) - \gamma\right)}\cos i(\pi - \beta) - \frac{\sin(\beta)}{\cos\left(\left(\frac{\beta\pi(R_g + R_c\sin\theta)}{180(R_g + 2R_w\sin\theta + R_c\sin\theta)}\right) - \gamma\right)}\cos\left(i\left(\frac{\pi}{2} + \left(\frac{\beta\pi(R_g + R_c\sin\theta)}{180(R_g + 2R_w\sin\theta + R_c\sin\theta}\right) - \gamma - \beta\right)\right)$$

based on the open-source python and the stability increase coefficient $A_i$, a stability diagram is obtained as shown in FIG. 5. When $A_i>0$, it is a stable area. Based on the inclination angle $\gamma$ of the supporting surface of the support plate, a range value of $\beta$ is selected in the stable area.

In this embodiment, the height difference h between the axis of the grinding wheel (the axis of the guide wheel) and the axis of the hard and brittle pipe fitting is determined based on the grinding angle $\beta$ of the grinding wheel. After the position of the hard and brittle pipe fitting is determined, the heights of the grinding wheel and the guide wheel can be determined based on the height difference h, thereby reducing the mounting difficulty of the grinding wheel and the guide wheel.

Furthermore, the height difference h determined based on the grinding angle $\beta$ of the grinding wheel can ensure the grinding accuracy of the external circle of the hard and brittle pipe fitting. Excessively large height difference h causes the guide wheel not to stably drive the rotation of the workpiece, leading to workpiece runout, whereas excessively small height difference h causes prismatic roundness to be generated on the surface of the hard and brittle pipe fitting. The height difference h determined based on the grinding angle $\beta$ can effectively guarantee the stable rounding of the external circle of the hard and brittle pipe fitting with large length-to-diameter ratio.

Finally, it should be noted that the above embodiments are used only to illustrate the technical solutions of the present disclosure rather than limit the scope of protection of the present disclosure. Although detailed descriptions are made to the present disclosure by referring to the preferred embodiments, those of ordinary skills in the prior arts should understand that modifications or equivalent substitutions can be made to the technical solutions of the present disclosure without departing from the essence and scope of the technical solutions of the present disclosure.

What is claimed is:

1. An over-positioning grinding method of a hard and brittle pipe fitting with a large length-to-diameter ratio comprising:

at step S1, assembling and positioning of the hard and brittle pipe fitting; penetrating a rigid mandrel through an internal hole of the hard and brittle pipe fitting with large length-to-diameter ratio such that the rigid mandrel is in clearance fit with the hard and brittle pipe fitting; tensioning the rigid mandrel and maintaining the hard and brittle pipe fitting horizontally; supporting a position at each end of the rigid mandrel and close to the hard and brittle pipe fitting by one vibration-damping device to lower vibration amplitude and frequency of the rigid mandrel in a machining process of the hard and brittle pipe fitting; providing a support plate and supporting the hard and brittle pipe fitting by contacting with an external pipe surface of the hard and brittle pipe fitting;

at step S2, determining a grinding area: disposing a grinding wheel and a guide wheel at one and other sides of the hard and brittle pipe fitting, respectively, and maintaining axes of the grinding wheel and the guide wheel at a same height; adjusting heights of the grinding wheel and the guide wheel to ensure there is a height difference between the axes of the guide wheel and the grinding wheel and an axis of the hard and brittle pipe fitting; opposing a guide supporting surface of the guide wheel in a forward direction by a grinding surface of the grinding wheel; enclose the grinding area of the hard and brittle pipe fitting, and carry out over-positioning supporting for the hard and brittle pipe fitting in cooperation with the rigid mandrel by the grinding wheel, the guide wheel and the support plate;

obtaining the height difference between the axes of the guide wheel and the grinding wheel and the axis of the hard and brittle pipe fitting as below:

a radius of the external circle of the hard and brittle pipe fitting with large length-to-diameter ratio is $R_w$, a radius of the guide wheel is $R_c$, a radius of the grinding wheel is $R_g$, and the height difference between the axis of the hard and brittle pipe fitting and the axis of the grinding wheel is h; when the grinding wheel comes in contact with the hard and brittle pipe fitting, an initial contact point of the grinding wheel and the hard and brittle pipe fitting is A, and a tangent line of the point A is l; when the guide wheel comes in contact with the hard and brittle pipe fitting, an initial contact point of the guide wheel and the hard and brittle pipe fitting is B; when the support plate comes in contact with the hard and brittle pipe fitting, an initial contact point of the support plate and the hard and brittle pipe fitting is C;

the axis of the hard and brittle pipe fitting is O, the center of the guide wheel is $O_c$, the center of the grinding wheel is $O_g$, $\angle AOC=\alpha$, $\angle BOC=\phi$, upper $\angle AO_gO_c=\beta_g$, upper $\angle O_gO_cB=\beta_c$, $\beta$ is a grinding angle of the grinding wheel, $\delta$ is an included angle between OA and a horizontal line, and an inclination angle of the supporting surface of the support plate is $\gamma$; when there is an offset angle $\theta$ between the axis of the grinding wheel and the axis of the hard and brittle pipe fitting, the grinding wheel grinds at the offset angle $\theta$ a contour projection of the sectional grinding wheel perpendicular to a feed speed direction; an elliptic curve equation in the $xO_gy$ is expressed as:

$$\frac{x^2}{(R_g\sin\theta)^2} + \frac{y^2}{R_g^2} = 1, \tag{1}$$

wherein $\Delta y$ is utilized to represent a height difference from the tangent point A to the axis of the grinding wheel, and $\Delta x$ is utilized to represent a horizontal distance from the tangent point A to the vertical axis y;

the following expression is obtained from the formula (1):

$$\Delta x = R_g\sin\theta\cos\beta_g \tag{2}$$

-continued $$\Delta y = R_g \sin \beta_g \tag{3}$$

a slope of the tangent line l through the tangent point A on the elliptic curve is expressed as: k=Δy/Δx:

$$k = -\frac{\cot \beta_g}{\sin \theta} \tag{4}$$

because the tangent value of the slope of the tangent line l is the included angle of the tangent line l and the X axis, the angle δ of the tangent line l and the x axis is obtained from the formula (4):

$$\frac{\pi}{2} - \delta = |\arctan(k)| \tag{5}$$

based on geometrical relationship, the following formula is obtained:

$$\beta_c \approx h/(R_w + R_c) \tag{6}$$

$$h = y + R_w \sin \delta \tag{7}$$

$$\beta = \beta + \delta = \pi - \phi - \alpha \tag{8}$$

the following is obtained by substituting δ, y, $\beta_c$ into the formulas (7) and (8):

$$\beta = \frac{h}{R_w + R_c} + \frac{\pi}{2} - \left|\arctan\left(-\frac{\cot \beta_g}{\sin \theta}\right)\right| \tag{9}$$

$$h = R_g \sin \beta_g + R_w \cos\left(\left|\arctan\left(-\frac{\cot \beta_g}{\sin \theta}\right)\right|\right) \tag{10}$$

in trigonometric function, when the angle is small, terms in formulas (9) and (10) are simplified as below:

$$\arctan\left(-\frac{\cot \beta_g}{\sin \theta}\right) \approx -\frac{\pi}{2} + \frac{\sin \theta}{\cot \beta_g} \tag{11}$$

$$\cot(\beta_g) \approx 1/\beta_g \tag{12}$$

therefore, when the formulas (11) and (12) are substituted into the formulas (9) and (10), the following is obtained:

$$\beta = \frac{h}{R_w + R_c} + \beta_g \sin \theta \tag{13}$$

$$h = R_g \beta_g + R_w \beta_g \sin \theta \tag{14}$$

by combining the formulas (13) and (14), the following is obtained:

$$h = \frac{(R_w + R_c)(R_g + R_w \sin \theta)}{R_g + 2R_w \sin \theta + R_c \sin \theta} \frac{\pi}{180} \beta. \tag{15}$$

at step S3, guide wheel positioning: moving the hard and brittle pipe fitting to the grinding area and moving the guide wheel toward the hard and brittle pipe fitting until the guide supporting surface of the guide wheel contacts and squeezes the external pipe surface of the hard and brittle pipe fitting so that a pre-pressure is present between the guide wheel and the hard and brittle pipe fitting: moving the hard and brittle pipe fitting out of the grinding area and remaining the guide wheel in original position;

at step S4, cutter alignment: driving the guide wheel to rotate forward to push the hard and brittle pipe fitting with large length-to-diameter ratio into the grinding area; contacting and driving the hard and brittle pipe fitting by the guide wheel to advance while rotating reversely; reversely rotating and performing micro feed toward the hard and brittle pipe fitting to realize cutter alignment operation by the grinding wheel;

at step S5, grinding the hard and brittle pipe fitting: setting a rotation speed and a feed speed of the guide wheel and a rotation speed and a feed speed of the grinding wheel, and setting a grinding amount of the hard and brittle pipe fitting; driving the guide wheel to rotate forward to push the hard and brittle pipe fitting with large length-to-diameter ratio into the grinding area, and contacting and driving the hard and brittle pipe fitting by the guide wheel while rotating the guide wheel reversely, and reversely rotating and performing the grinding wheel to feed toward the hard and brittle pipe fitting; along with grinding and feeding of the grinding wheel, the guide wheel and the support plate perform feed toward the hard and brittle pipe fitting so as to always maintain the over-positioning supporting of the guide wheel, the support plate and the rigid mandrel for the hard and brittle pipe fitting.

2. The over-positioning grinding method of the hard and brittle pipe fitting with large length-to-diameter ratio according to claim 1, wherein in the step S5, a linear speed of the grinding wheel is 30 m/s.

3. The over-positioning grinding method of the hard and brittle pipe fitting with large length-to-diameter ratio according to claim 1, wherein in the step S5, when an external diameter of the grinding wheel is 400 mm, the rotation sped of the grinding wheel is 1400 rpm/min to 1500 rpm/min.

4. The over-positioning grinding method of the hard and brittle pipe fitting with large length-to-diameter ratio according to claim 1, wherein in the step S5, the working rotation speed of the guide wheel is 15 rpm/min to 20 rpm/min.

5. The over-positioning grinding method of the hard and brittle pipe fitting with large length-to-diameter ratio according to claim 1, wherein a fit clearance of the rigid mandrel and the hard and brittle pipe fitting is 0.2 to 0.5 mm.

6. The over-positioning grinding method of the hard and brittle pipe fitting with large length-to-diameter ratio according to claim 1, further comprising: disposing the support plate close to the grinding wheel and obliquely supports the hard and brittle pipe fitting by the support plate; a supporting surface of the support plate is an inclined surface, and an inclination angle of the supporting surface is 30°.

7. The over-positioning grinding method of the hard and brittle pipe fitting with large length-to-diameter ratio according to claim 1, wherein the grinding wheel is a parallel grinding wheel.

8. The over-positioning grinding method of the hard and brittle pipe fitting with large length-to-diameter ratio according to claim 1, wherein the grinding wheel is a cup-shaped grinding wheel, and there is the offset angle θ between the axis of the cup-shaped grinding wheel and the axis of the hard and brittle pipe fitting, wherein $\theta>0$.

9. The over-positioning grinding method of the hard and brittle pipe fitting with large length-to-diameter ratio according to claim 1, wherein the grinding angle $\beta$ is obtained in the following process:

based on geometrical relationship, the following formulas are obtained:

$$\alpha = \frac{\pi}{2} - \delta - \gamma \tag{16}$$

$$\phi = \frac{\pi}{2} - \beta_c - \gamma \tag{17}$$

a stability increase coefficient $A_i$ is expressed as:

$$A_i = 1 + \frac{\sin(\alpha)}{\sin(\phi)}\cos i(\alpha+\phi) - \frac{\sin(\alpha+\phi)}{\sin(\phi)}\cos(i\alpha) \tag{18}$$

in combination with the formulas (4) to (17), the formula (18) is converted into the following formula with only variables angles $\beta$ and $\gamma$:

$$A_i = 1 + \frac{\sin\left(\frac{\pi}{2} + \left(\frac{\beta\pi(R_g + R_c\sin\theta)}{180(R_g + 2R_w\sin\theta + R_c\sin\theta}\right) - \gamma - \beta\right.}{\cos\left(\left(\frac{\beta\pi(R_g + R_c\sin\theta)}{180(R_g + 2R_w\sin\theta + R_c\sin\theta}\right) - \gamma\right)}\cos i(\pi-\beta) - \frac{\sin(\beta)}{\cos\left(\left(\frac{\beta\pi(R_g + R_c\sin\theta)}{180(R_g + 2R_w\sin\theta + R_c\sin\theta)}\right) - \gamma\right)}\cos\left(i\left(\frac{\pi}{2} + \left(\frac{\beta\pi(R_g + R_c\sin\theta)}{180(R_g + 2R_w\sin\theta + R_c\sin\theta}\right) - \gamma - \beta\right)\right)$$

based on an open-source python and the stability increase coefficient $A_i$, a stability diagram is obtained; when $A_i>0$, it is a stable area; based on the inclination angle $\gamma$ of the supporting surface of the support plate, a range value of $\beta$ is selected in the stable area.

* * * * *